US007332099B2

(12) United States Patent
Church et al.

(10) Patent No.: US 7,332,099 B2
(45) **Date of Patent: *Feb. 19, 2008**

(54) ION BOMBARDMENT OF ELECTRICAL LAPPING GUIDES TO DECREASE NOISE DURING LAPPING PROCESS

(75) Inventors: Mark A. Church, Los Gatos, CA (US); Wipul Pemsiri Jayasekara, San Jose, CA (US); Howard Gordon Zolla, San Jose, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 90 days.

This patent is subject to a terminal disclaimer.

(21) Appl. No.: 11/246,727

(22) Filed: Oct. 6, 2005

(65) Prior Publication Data

US 2006/0027528 A1 Feb. 9, 2006

Related U.S. Application Data

(63) Continuation of application No. 10/377,854, filed on Feb. 28, 2003, now Pat. No. 6,982,042.

(51) Int. Cl.
*G11B 5/127* (2006.01)

(52) U.S. Cl. ..... 216/22; 216/52; 216/59; 216/66; 216/67; 451/5; 451/41; 427/130; 204/192.34; 29/603.08; 29/603.15; 29/603.16

(58) Field of Classification Search ..... None
See application file for complete search history.

(56) References Cited

U.S. PATENT DOCUMENTS

| | | | | |
|---|---|---|---|---|
| 6,083,081 | A * | 7/2000 | Fukuroi et al. | 451/5 |
| 6,132,290 | A * | 10/2000 | Sugiyama et al. | 451/10 |
| 6,193,584 | B1 * | 2/2001 | Rudy et al. | 451/5 |
| 6,347,983 | B1 * | 2/2002 | Hao et al. | 451/57 |
| 6,609,948 | B1 * | 8/2003 | Fontana et al. | 451/5 |
| 6,732,421 | B2 * | 5/2004 | Gates et al. | 29/603.12 |
| 6,741,429 | B1 * | 5/2004 | Baglin et al. | 360/313 |
| 2002/0001671 | A1 * | 1/2002 | Fukuroi et al. | 427/131 |
| 2003/0020467 | A1 * | 1/2003 | Kasahara et al. | 324/207.21 |
| 2003/0107848 | A1 * | 6/2003 | Watanabe et al. | 360/320 |
| 2004/0027732 | A1 * | 2/2004 | Kelly et al. | 360/324.1 |

OTHER PUBLICATIONS

The Notice of Allowance from U.S. Appl. No. 10/964,123 mailed on Sep. 26, 2007.

* cited by examiner

*Primary Examiner*—Anita K Alanko
(74) *Attorney, Agent, or Firm*—Zilka-Kotab, PC

(57) ABSTRACT

A method for reducing noise in a lapping guide. Selected portions of a magnetoresistive device wafer are bombarded with ions such that a magnetoresistive effect of lapping guides is reduced. The device is lapped, using the lapping guides to measure an extent of the lapping.

26 Claims, 4 Drawing Sheets

ION BOMBARDMENT OF ELECTRICAL LAPPING GUIDES TO DECREASE NOISE DURING LAPPING PROCESS

RELATED APPLICATIONS

This application is a continuation of U.S. patent application Ser. No. 10/377,854 to Church et al., filed Feb. 28, 2003, now U.S. Pat. No. 6,982,042.

FIELD OF THE INVENTION

The present invention relates to magnetic head fabrication, and more particularly, this invention relates to reducing noise during ABS-lapping of MR/GMR/AMR/TMR/etc. heads.

BACKGROUND OF THE INVENTION

The Stripe Height (SH) of a plurality of Giant Magnetoresistive Effect (GMR) heads is collectively controlled by lapping the Air Bearing Surface (ABS) of each bar obtained by cutting each row from a wafer so that the plurality of GMR heads are aligned in one row. To control the mutual GMR height of the plurality of GMR heads of a bar and the mutual GMR height of the GMR heads of a plurality of bars to a corrective value, there are usually provided a plurality of lapping control sensors called an electric lapping guide (ELG) or a resistance lapping guide (RLG) which detects the height of a lapped ABS surface, in each bar. The lapping of the ABS surface can be controlled in response to electric signals from the ELGs or RLGs. For simplicity, the remainder of the discussion shall refer to ELGs, it being understood that the processes described herein apply to both ELGs and RLGs.

Each of the ELGs is mainly composed of a resistive element which is adjacent to the ABS surface to be lapped and extends in parallel. The ELG teaches an amount of lapping by changing its terminal voltage or its resistance due to the reduction of the height of the resistive element polished with polishing of the GMR height. Such ELG with respect to the throat height of a magnetic pole gap in an inductive head, not to the GMR height, is known by, for example, U.S. Pat. No. 4,689,877.

In manufacturing the GMR head, the ELG is generally formed in the same process of manufacturing the GMR head so as to have the same layered structure as that of the GMR head. FIG. 1 shows a multi-layered structure 100 of a conventional ELG. As shown in the figure, the conventional ELG has a multi-layered structure consisting of an optional metallic layer (shield layer) 102, an insulation layer (shield gap layer) 104, a resistive element layer (GMR sensor) 106 and lead conductors 108, which are usually made of the same material and layer thickness as those of the GMR head.

FIG. 2A shows an example of a prior art electrical lapping guide (ELG) 200, that has been used to provide an indication of Stripe Height (SH) during the lapping process. FIG. 2A depicts a slider bar in cross section at a layer including the read sensor 204, and associated leads 206. A resistive element 208 is electrically connected to the controller 210 through the leads 212. During the lapping process, a current passes through the resistive element. As the lapping occurs along the lapping plane L, and while the stripe height, SH, of the read sensor is decreased, the height of the resistive element is decreased. Over time during the lapping process, changes in the resistance of the resistive element, due to the changing height, can be detected by the controller. Such changes in resistance over time is shown in FIG. 2B.

Knowing the material properties and dimensions of the resistive element relative to material properties and dimensions of the read sensor, the measured resistance Rc during the lapping process can be used to calculate an approximate height of the read sensor during the lapping process. Such a calculated height is shown over time in FIG. 2B by curves 262, 264, 266, where curves 262 and 264 are for GMR sensors and curve 266 is for an AMR sensor.

Precise stripe height control in the GMR head is achievable only when the relationship between the ELG resistance and stripe height is both known and easily measured. Using current methods, the magnetic state of the ELGs are altered by the lapping process itself. Since in a GMR head, the electrical resistance is directly related to the magnetic state, noise spikes occur during lapping, as shown in FIG. 2B. These noise spikes place a limit on the achievable resolution and accuracy of an ELG-controlled lapping process.

The imprecision caused by noise in ELG signals has been addressed, but with little success. In one method, separate, non magnetic, material are used for the ELGs. The difficulty here lies in complexity since several additional processing steps must be introduced. Also, for practical reasons, the ELG and the GMR sensor need to be patterned simultaneously using ion milling. This means that these two materials must be matched in such a way that they mill in exactly the same time. While this is workable, it constrains the choices of materials, thickness and resistances available.

Another method considered consists of installing a very large magnet in the lapping tool to suppress magnetic switching. However, this is rather impractical.

What is therefore needed is a way to reduce or eliminate the noise problem caused by GMR effects in the ELGs during lapping.

SUMMARY OF THE INVENTION

The present invention solves the problems described above by providing a way to reduce or eliminate the magnetoresistive (MR) effect in the ELGs such that, during lapping, the noise problem is reduced or eliminated. It should be understood that the processes described and claimed herein apply to any type of magnetoresistive device, including GMR/AMR/MR/TMR/etc. devices.

In one embodiment, selected portions of a magnetoresistive device wafer are masked, thereby defining masked and unmasked regions of the MR device wafer in which the unmasked regions include lapping guides. The MR device wafer is bombarded with ions such that a magnetoresistive effect of the unmasked regions is reduced. The MR devices are lapped, using the lapping guides to measure an extent of the lapping.

The MR device wafer may include one or more disk read and/or write heads. The MR device wafer could also, or alternatively, include one or more tape read and/or write heads.

As mentioned above, the ion bombardment reduces the MR effect in the unmasked regions, which includes the lapping guides. One way it does this is by milling material from the unmasked regions. Another way is by causing intermixing of materials in the unmasked regions. Yet another way is by causing both milling and intermixing. A further way is causing a chemical change in the unmasked regions, such as by oxidation.

The ion bombardment that reduces the MR effect in the unmasked regions can be effectuated by many different methods. One method is by ion milling. Another method is by implanting. Yet another is by sputter etching. A further method is by reactive ion etching.

As an optional step, the masking may be removed.

BRIEF DESCRIPTION OF THE DRAWINGS

For a fuller understanding of the nature and advantages of the present invention, as well as the preferred mode of use, reference should be made to the following detailed description read in conjunction with the accompanying drawings.

Prior Art

Prior Art

Prior Art

BEST MODE FOR CARRYING OUT THE INVENTION

The following description is the best embodiment presently contemplated for carrying out the present invention. This description is made for the purpose of illustrating the general principles of the present invention and is not meant to limit the inventive concepts claimed herein.

Figure 1:
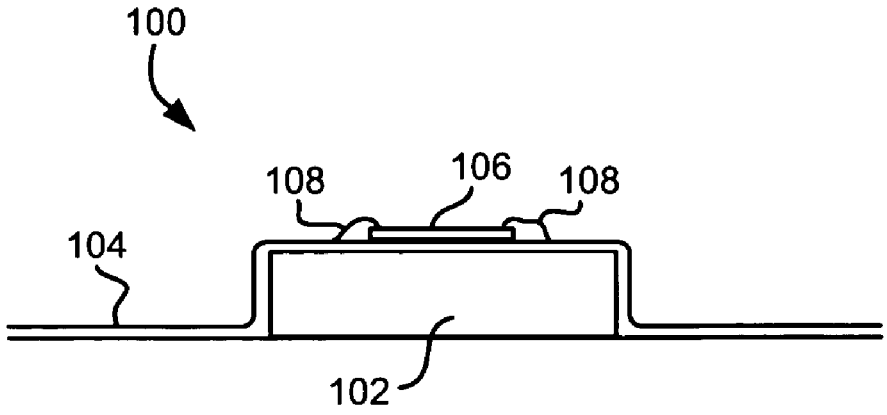
FIG. 1 (PRIOR ART)
FIG. 1 is a cross-sectional view of a multilayered structure of a conventional ELG.
Figure 2A:
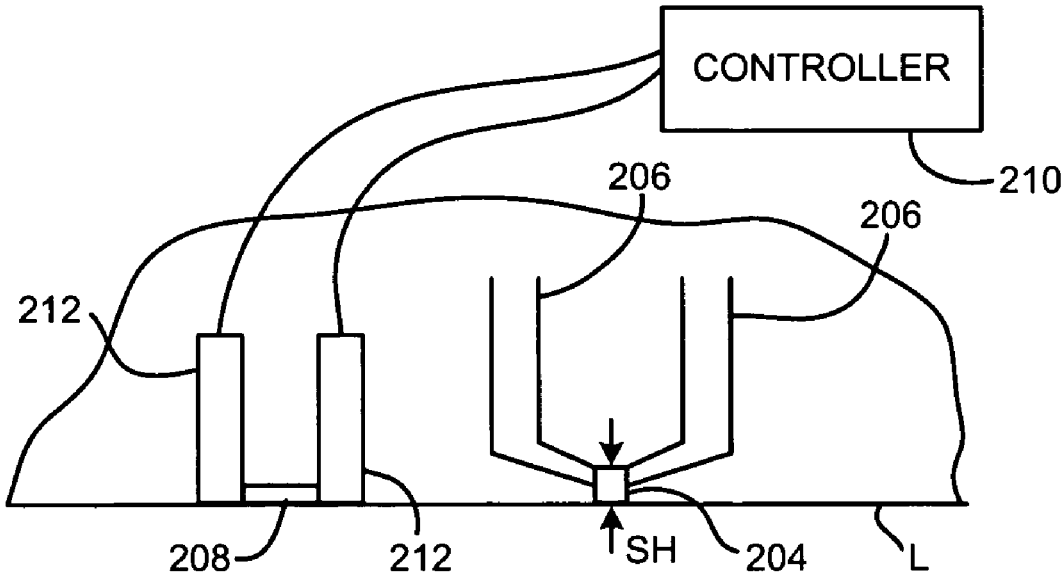
FIG. 2A (PRIOR ART)
FIG. 2A is a partial cross sectional view of a GMR device wafer with a prior art ELG and a read sensor.
Figure 2B:
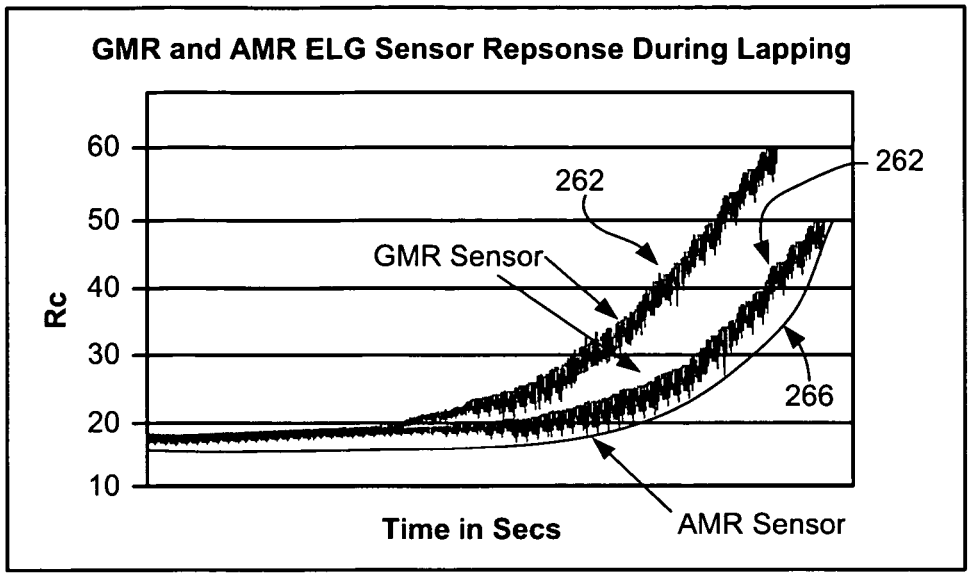
FIG. 2B (PRIOR ART)
FIG. 2B is a graphical depiction of resistances for various types of GMR devices over time during a lapping process.
Figure 3:
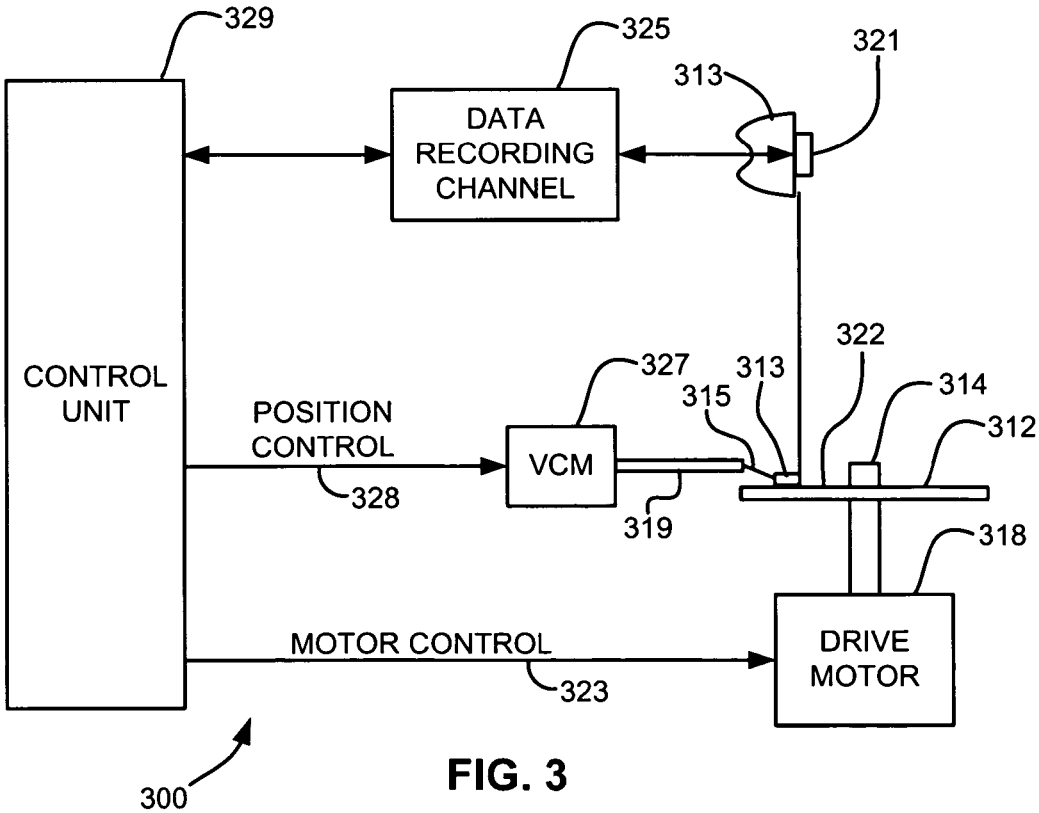
FIG. 3 is a perspective drawing of a magnetic recording disk drive system in accordance with one embodiment.

Referring now to FIG. 3, there is shown a disk drive 300 embodying the present invention. As shown in FIG. 3, at least one rotatable magnetic disk 312 is supported on a spindle 314 and rotated by a disk drive motor 318. The magnetic recording media on each disk is in the form of an annular pattern of concentric data tracks (not shown) on disk 312.

At least one slider 313 is positioned on the disk 312, each slider 313 supporting one or more magnetic read/write heads 321. As the disks rotate, slider 313 is moved radially in and out over disk surface 322 so that heads 321 may access different tracks of the disk where desired data are recorded. Each slider 313 is attached to an actuator arm 319 by way of a suspension 315. The suspension 315 provides a slight spring force which biases slider 313 against the disk surface 322. Each actuator arm 319 is attached to an actuator means 327. The actuator means 327 as shown in FIG. 3 may be a voice coil motor (VCM). The VCM comprises a coil movable within a fixed magnetic field, the direction and speed of the coil movements being controlled by the motor current signals supplied by controller 329.

During operation of the disk storage system, the rotation of disk 312 generates an air bearing between slider 313 and disk surface 322 which exerts an upward force or lift on the slider. The air bearing thus counter-balances the slight spring force of suspension 315 and supports slider 313 off and slightly above the disk surface by a small, substantially constant spacing during normal operation.

The various components of the disk storage system are controlled in operation by control signals generated by control unit 329, such as access control signals and internal clock signals. Typically, control unit 329 comprises logic control circuits, storage means and a microprocessor. The control unit 329 generates control signals to control various system operations such as drive motor control signals on line 323 and head position and seek control signals on line 328. The control signals on line 328 provide the desired current profiles to optimally move and position slider 313 to the desired data track on disk 312. Read and write signals are communicated to and from read/write heads 321 by way of recording channel 325.

The above description of a typical magnetic disk storage system, and the accompanying illustration of FIG. 3 are for representation purposes only. It should be apparent that disk storage systems may contain a large number of disks and actuators, and each actuator may support a number of sliders. Further, it should be understood that the teachings found herein are equally applicable to the processing of any type of magnetic head, including tape heads.

Figure 4A:
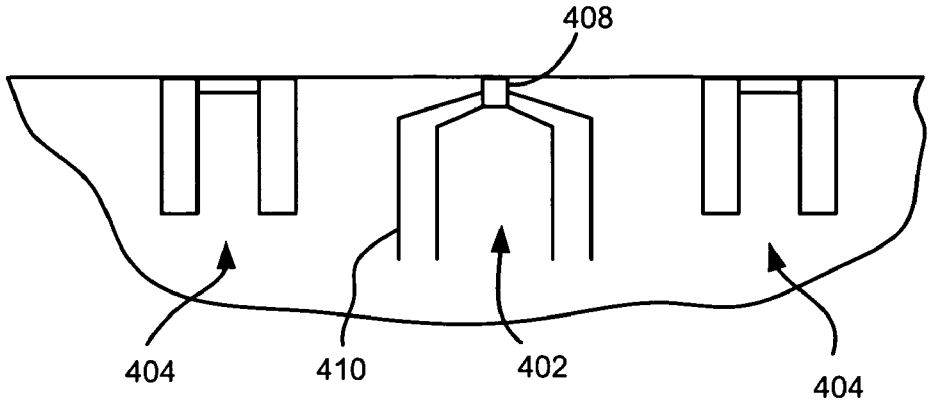
FIG. 4A is a partial plan view of a GMR device wafer.

FIG. 4A depicts a wafer that has been created by forming a plurality of layers on a substrate (not drawn to scale). With the film created have been formed a plurality of head structures 402 and a plurality of lapping guides 404.

At the wafer level, subsequent to the deposition of the GMR film, a mask is used which protects the sensor region but exposes the region of the wafer containing the ELG, RLG, or any other type of lapping control sensor. Again, for simplicity, the term ELG will be used throughout the discussion, but will refer to ELGs, RLGs, or any other type of lapping control sensor.

Figure 4B:
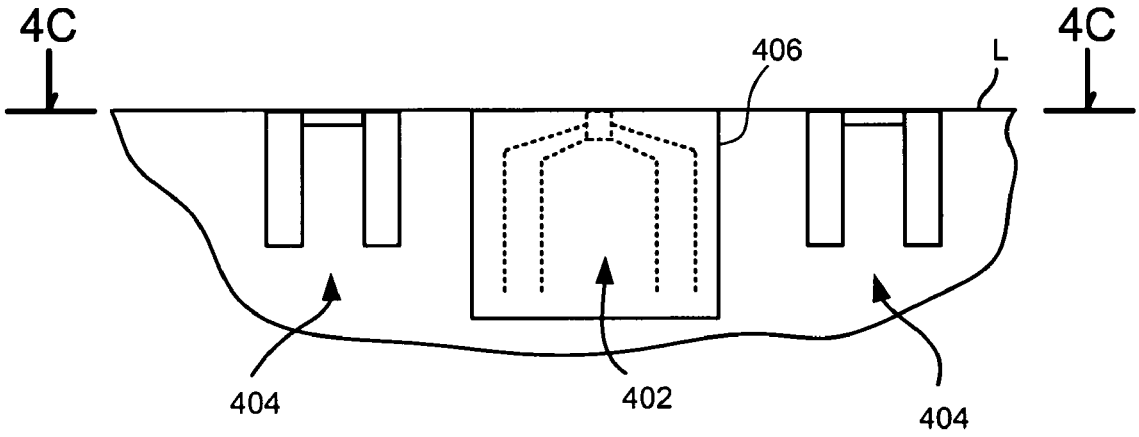
FIG. 4B is a partial plan view of the GMR device wafer of FIG. 4A with a mask applied to the surface to be lapped.

FIG. 4B shows the GMR device wafer 400 of FIG. 4A with a mask 406 applied to the wafer 400. Any suitable masking technique can be used. For example, the mask can be lithographically-defined photoresist or can be the consequence of another processing step such as gap deposition in which the mask material might be Alumina. The choice is completely general. Further, the masked area can include the sensor 408, leads 410, and any other components/areas desired to be protected from ion bombardment.

Alternatively, by the time the GMR device wafer is ready to be irradiated, there may already be another structure that covers the sensor, so masking would be unnecessary.

Figure 4C:
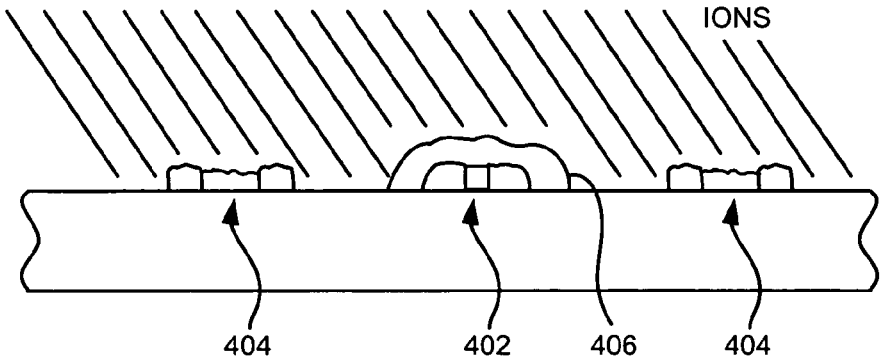
FIG. 4C is a partial cross sectional view of ion bombardment of the GMR device wafer of FIG. 4B as seen along plane 4C of FIG. 4B.

Subsequent to mask fabrication the wafer is bombarded by ions, as shown in FIG. 4C. There are several choices for performing this step.

In a first preferred embodiment, a conventional "ion miller," or ion beam etcher, is used to accelerate ions at the GMR device wafer in a vacuum. The exposed ELG is bombarded for a short period of time under low energy conditions, such as <1000 eV for example. This has the effect of sputtering or damaging the top magnetic layer of the sensor in the ELG region, which in turn suppresses GMR, TMR, AMR, etc. (MR) effects.

Some loss of GMR is due to milling (material loss) and some to bombardment and implantation effect which causes intermixing of materials in exposed portions of the layered structure, as described below. Preferred ions for milling are Ar, Xe, or other inert gas. However, reactive ions such as oxygen or nitrogen may be used as well.

Figure 5:
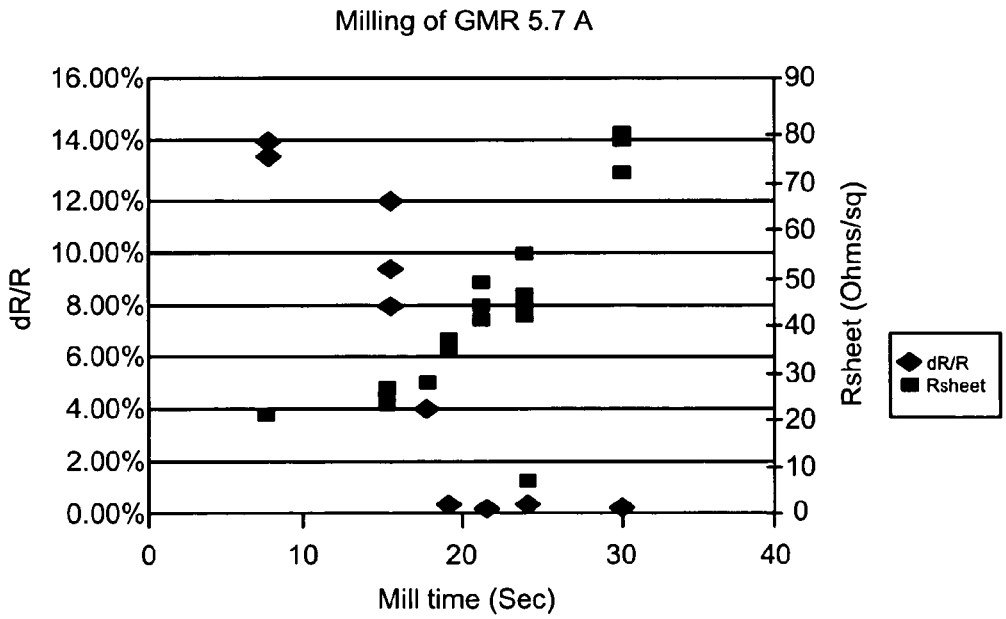
FIG. 5 is a graphical depiction illustrating the effect of ion milling on an ELG.

FIG. 5 is a graph 500 that illustrates an illustrative effect of ion milling on an ELG. As can be seen in this example, 19 seconds of ion milling at 500 eV Ar reduces the dR/R of a conventional GMR sensor to at or near zero. As also shown, the resistance (R sheet) of the ELG increases as the thickness of the ELG is reduced by the milling. Note that the amount of material milled from the ELG need not be large;

rather the milling need only be performed long enough to reduce the GMR effect to the desired level.

In a second preferred embodiment, an ion implanter such as a plasma immersion ion implanter or conventional ion implanter is used to suppress GMR effects. While such machines are typically used to implant dopants in the surface of semiconductor wafers to form heterojunctions to make transistors, here they are used primarily to disrupt the GMR of the structure. The MR, GMR, TMR, AMR, etc. (GMR) sensor is composed of many layers of film. In an ion implanter, which operates at a much higher energy than the ion miller, mixing is the primary cause of reduction of MR effect. When ions pass through the layers, they cause the layers to mix as a function of ion size and energy of the particle.

The energy that can be used in ion implantation is preferably in the 3-30 kV range, but can be much higher, such as in the 3-300 kV range, or higher. Sputtering is less important as a mechanism of GMR suppression; disorder causes more GMR suppression in this embodiment.

In a third preferred embodiment, a sputter etch is used to reduce the MR, GMR, TMR, AMR, etc. (GMR) effect. In a preferred process, a wafer sits on an energy source in a vacuum chamber, gas such as Ar is introduced into the chamber, and RF energy is applied directly to the wafer, causing ionization of the gas. These ions bombard the surface directly. The sputter etch could be nonreactive using Ar or reactive, using oxygen for example. Each would have the effect of destroying the GMR of the ELG via physical damage sputtering and/or intermixing. By introducing oxygen, the GMR stack can be chemically altered so that it is no longer effective as a GMR layer.

In a fourth embodiment, a reactive ion etcher is used in a similar manner as the sputter etch. The result is also very similar, and therefore use of reactive ion etching will not be discussed in detail.

Removal of the mask is optional. If the mask was added specifically for the purpose of this invention, i.e., protecting certain parts of the GMR device from ion bombardment, then it may be desirable to remove the mask. If it is a photoresist mask, it can be chemically stripped in either dry or wet chemistry. If the mask is Silicon Dioxide or Aluminum Oxide, the mask buildup can potentially be used for other purposes.

After the above processing is complete, the wafer can be conventionally processed, including a lapping process to achieve the desired stripe height of the sensor, additional slicing, dicing, etc.

While various embodiments have been described above, it should be understood that they have been presented by way of example only, and not limitation. For example, the structures and methodologies presented herein are generic in their application to all MR heads, AMR heads, GMR heads, TMR heads, spin valve heads, tape and disk heads, etc. Thus, the breadth and scope of a preferred embodiment should not be limited by any of the above-described exemplary embodiments, but should be defined only in accordance with the following claims and their equivalents.

What is claimed is:

1. A method for lapping a magnetoresistive device, comprising:

bombarding regions of a magnetoresistive device wafer with ions such that a magnetoresistive effect of the bombarded regions is reduced, the bombarded regions including lapping guides;

lapping at least a section of the wafer; and using the lapping guides to measure an extent of the lapping, wherein the lapping guides have a defined track width prior to the bombardment.

2. The method as recited in claim 1, wherein the magnetoresistive device wafer includes a disk drive head.

3. The method as recited in claim 1, wherein the magnetoresistive device wafer includes a tape head.

4. The method as recited in claim 1, wherein the ion bombardment reduces the magnetoresistive effect in the unmasked regions by removing material from the unmasked regions.

5. The method as recited in claim 1, wherein the ion bombardment reduces a magnetoresistive effect in the unmasked regions by causing intermixing of materials in the unmasked regions.

6. The method as recited in claim 1, wherein the ion bombardment reduces a magnetoresistive effect in the unmasked regions by causing both removal of material and intermixing.

7. The method as recited in claim 1, wherein the ion bombardment is effectuated by ion milling.

8. The method as recited in claim 1, wherein the ion bombardment is effectuated by implanting.

9. The method as recited in claim 1, wherein the ion bombardment is effectuated by spitter etching.

10. The method as recited in claim 1, wherein the ion bombardment is effectuated by reactive ion etching.

11. The method as recited in claim 1, wherein the ion bombardment causes at least one of oxidation and nitridation.

12. The method as recited in claim 1 wherein the magnetoresistive device is a TMR device.

13. A method for reducing a magnetoresistive effect of lapping guides of a magnetoresistive device wafer, comprising:

bombarding lapping guides of a magnetoresistive device with ions such that a magnetoresistive effect of the lapping guides is reduced, wherein the lapping guides have a defined track width prior to the bombardment.

14. The method as recited in claim 13, wherein the ion bombardment reduces the magnetoresistive effect in the lapping guides by removing material from the lapping guides.

15. The method as recited in claim 13, wherein the ion bombardment reduces the magnetoresistive effect in the lapping guides by causing intermixing of materials in the lapping guides.

16. The method as recited in claim 13, wherein the ion bombardment reduces a magnetoresistive effect in the lapping guides by causing both removal of material and intermixing in the lapping guides.

17. The method as recited in claim 13, wherein the ion bombardment is effectuated by at least one of ion milling, implanting, sputter etching, and reactive ion etching.

18. The method as recited in claim 13, wherein the ion bombardment causes at least one of oxidation and nitridation.

19. The method as recited in claim 13, wherein the magnetoresistive device wafer includes a disk drive head.

20. The method as recited in claim 13, wherein the magnetoresistive device wafer includes a tape head.

21. The method as recited in claim 13, wherein the magnetoresistive device is a TMR device.

22. A method for processing a magnetoresistive device wafer, comprising:

forming a plurality of layers on a substrate, wherein a plurality of head structures and a plurality of lapping guides are formed in the layers, wherein the head structures and lapping guides have defined track widths;

masking the head structures for defining masked and unmasked regions, the lapping guides being in the unmasked regions;

bombarding the wafer with ions for reducing a magnetoresistive effect in the lapping guides;

lapping at least a section of the magnetoresistive device wafer after the bombarding; and using the lapping guides to measure an extent of the lapping.

23. The method as recited in claim 22, wherein the ion bombardment is effectuated by at least one of ion milling, implanting, sputter etching, and reactive ion etching.

24. The method as recited in claim 22, wherein the ion bombardment causes at least one of oxidation and nitridation.

25. The method as recited in claim 22, wherein the magnetoresistive device wafer includes a disk drive head.

26. The method as recited in claim 22, wherein the magnetoresistive device wafer includes a tape head.

* * * * *

UNITED STATES PATENT AND TRADEMARK OFFICE

CERTIFICATE OF CORRECTION

PATENT NO. : 7,332,099 B2
APPLICATION NO. : 11/246727
DATED : February 19, 2008
INVENTOR(S) : Church et al.

It is certified that error appears in the above-identified patent and that said Letters Patent is hereby corrected as shown below:

In claim 9, column 6, line 28, replace "spitter" with --sputter--.

Signed and Sealed this

Twentieth Day of July, 2010

David J. Kappos

David J. Kappos
*Director of the United States Patent and Trademark Office*